US007794042B2

(12) United States Patent
Mizes et al.

(10) Patent No.: US 7,794,042 B2
(45) **Date of Patent: *Sep. 14, 2010**

(54) SYSTEMS AND METHODS FOR REDUCING PROCESS DIRECTION REGISTRATION ERRORS OF A PRINTHEAD USING A LINEAR ARRAY SENSOR

(75) Inventors: Howard A. Mizes, Pittsford, NY (US); Peter Paul, Webster, NY (US); Stanley J. Wallace, Victor, NY (US); Michael D. Borton, Ontario, NY (US); Kenneth R. Ossman, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/471,924

(22) Filed: May 26, 2009

(65) Prior Publication Data

US 2009/0231382 A1 Sep. 17, 2009

Related U.S. Application Data

(62) Division of application No. 10/998,632, filed on Nov. 30, 2004, now Pat. No. 7,552,986.

(51) Int. Cl.
*B41J 29/393* (2006.01)

(52) U.S. Cl. ..... 347/19; 347/5; 347/9

(58) Field of Classification Search ..... 347/5, 347/9, 16, 19, 116, 338, 238, 37
See application file for complete search history.

(56) References Cited

U.S. PATENT DOCUMENTS

| | | | | |
|---|---|---|---|---|
| 7,552,986 | B2 * | 6/2009 | Mizes et al. | 347/19 |
| 2002/0130922 | A1 | 9/2002 | Okawa et al. | |
| 2005/0018006 | A1 | 1/2005 | Im et al. | |

* cited by examiner

*Primary Examiner*—Lam S Nguyen
(74) *Attorney, Agent, or Firm*—Oliff & Berridge, PLC

(57) ABSTRACT

Systems and methods are provided for detecting process direction registration errors in a printer. The errors are detected by analyzing a metric of a dash minimum response obtained from a test pattern. The test pattern contains dashes. At least one dash is shifted in the process direction in relation to another dash.

10 Claims, 9 Drawing Sheets

SYSTEMS AND METHODS FOR REDUCING PROCESS DIRECTION REGISTRATION ERRORS OF A PRINTHEAD USING A LINEAR ARRAY SENSOR

This is a Division of application Ser. No. 10/998,632 filed Nov. 30, 2004, issued as U.S. Pat. No. 7,552,986. The disclosure of the prior application is hereby incorporated by reference herein in its entirety.

BACKGROUND OF THE INVENTION

1. Field of Invention

This invention relates to systems and methods for reducing process direction registration errors of a printhead using a linear array sensor.

2. Description of Related Art

Fast printing with a direct marking engine requires the use of multiple printheads. For example, four aligned printheads may be used in a printer to write to a drum rotating underneath them. Each printhead has six degrees of positional freedom, three translational and three rotational. The printheads need be precisely aligned so that there is a smooth transition from one printhead to the other in the printed image.

In order to achieve a high resolution, it may also be necessary for the drum of the printer to make multiple passes while the printheads are translated after each rotation along the axis of the drum. In this case, the transition of the printhead needs to be precise, to achieve equal spacing between the centers of the printed lines during the passes.

SUMMARY OF THE INVENTION

When a printer uses a plurality of printheads to write to a drum rotating underneath them, print defects can occur at the boundary between two printheads, if the two printheads are not precisely aligned. These print defects include roll and y-axis stitch.

In particular, roll can occur as a rotation of a printhead about an axis normal to the drum. Roll causes a skew of the image produced by the printhead relative to the print medium, such as paper. If an image was printed entirely with a single printhead, small amounts of roll would not be perceivable. However, if an image was printed with at least two printheads, the roll of one of the printheads will cause a translation of the printed image in the process direction at the interface between the two printheads. Such a translation causes an objectionable streak.

Y-axis stitch may be defined as a translation of one printhead compared to another printhead in a direction parallel to the rotation of the drum. Y-axis stitch shifts the image from one printhead with respect to the other printhead in the process direction. Such a y-axis stitch causes a noticeable streak at the interface between the two printheads.

When a printhead uses multiple passes to produce high resolution images, another print defect, the y-axis interlace, may occur. The y-axis interlace may be defined as a timing error between multiple passes of the printhead. In particular, if the pass-to-pass timings do not align, a single-pixel wide line written in the cross process direction will appear jagged, although the intent was to make it straight. The pass-to-pass errors can also introduce high frequency banding in a halftone image.

Various exemplary embodiments according to the present invention provide systems and methods for reducing process direction registration errors using test patterns. In various exemplary embodiments, a method for detecting process direction registration errors comprises obtaining a first dash minimum response curve, the first dash minimum response curve outlining a first plurality of minimal responses sensed from a first plurality of dashes in a test pattern, the dashes in the test pattern including being spaced substantially equally in a cross process direction, each dash extending substantially the same length in a process direction, the process direction perpendicular to the cross process direction, at least one dash having a position shift in the process direction from a neighboring dash; obtaining a second dash minimum response curve, the second dash minimum response curve outlining a second plurality of minimal responses sensed from a second plurality of dashes in the test pattern; and determining a difference in phase and/or frequency between the first and second sinusoidal curves.

This and other features and advantages of this invention are described in, or apparent from, the following detailed description of various exemplary embodiments of the systems and methods according to this invention.

BRIEF DESCRIPTION OF THE DRAWINGS

Various exemplary embodiments of the systems and methods of this invention will be described in detail, with reference to the following figures, wherein.

DETAILED DESCRIPTION OF EXEMPLARY EMBODIMENTS

Figure 1:
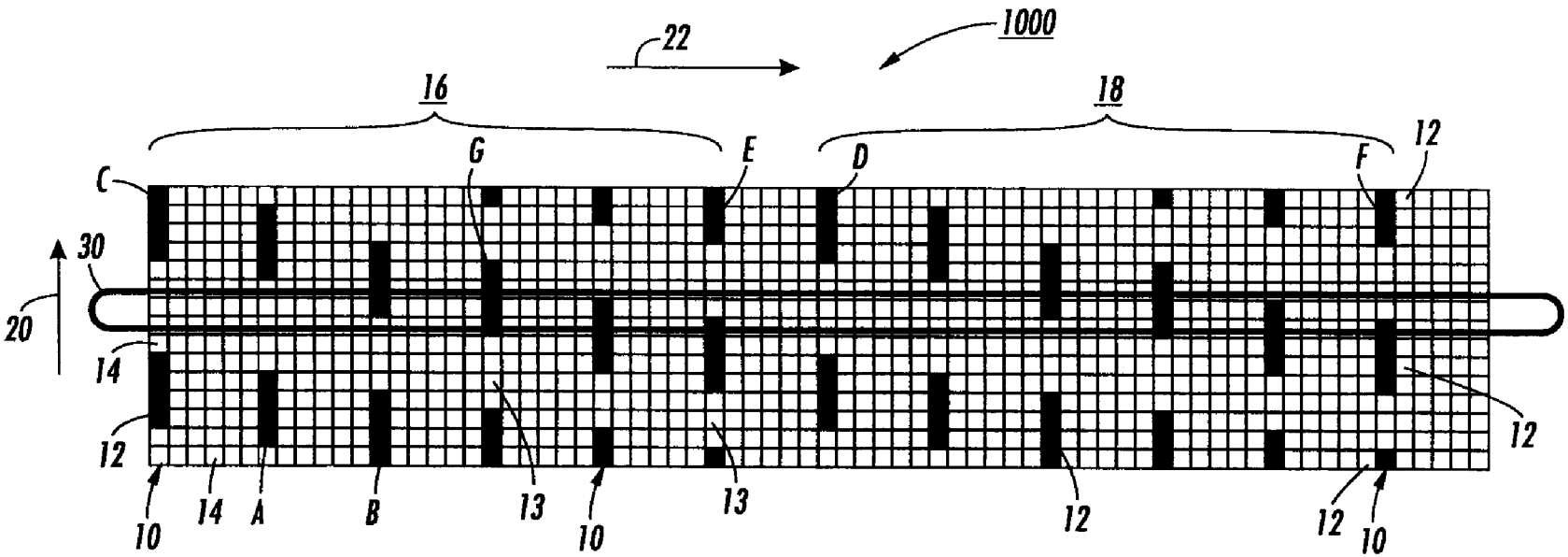
FIG. 1 illustrates a first exemplary embodiment of a test pattern according to this invention.

FIG. 1 illustrates an exemplary embodiment of a test pattern 1000 according to this invention. As shown in FIG. 1, the test pattern 1000 may include a plurality of dashed lines 10. Each dashed line 10 extends in the process direction 20 (the vertical direction or y-axis direction). The plurality of dashed lines 10 are substantially equally spaced or separated from each other in the cross process direction 22 (horizontal direction, or x-axis direction).

As shown in FIG. 1, each dashed line 10 includes a plurality of dashes 12 running in the process direction 20. The dashes 12 of a dashed line 10 are substantially equally spaced or separated from each other in the process direction 20.

As shown in FIG. 1, a dash 12 in a dashed line 20 is shifted for a certain number of pixels 14 in the process direction 20 relative to a dash 12 of a neighboring dashed line 10. For example, as shown in FIG. 1, dash A is ahead of dash B in the process direction 20. The shift may be any number of pixels. For example, as shown in FIG. 1, dash A is one pixel ahead in the process direction 20 than dash B.

As shown in FIG. 1, the test pattern 1000 periodically repeats the configuration of a plurality of dashed lines 10 in the cross process direction 22. For example, as shown in FIG. 1, dashed line groups 16 and 18 have similar configuration. In particular, dashes C and D are located at substantially the same process direction location. Dashes E and F are also located at substantially the same process direction location.

In various exemplary embodiments, the dashes 12 are spaced far enough apart in the cross process direction 22 (x-axis direction) so that they can be distinguished by a full width array sensor. The dashes 12 are long enough in the process direction 20 (y-axis direction) so that end effects do not affect the shape of the dashes 12 as detected by the sensor.

Each dashed line 10 includes periodical occurrences of dashes 12 and gaps 13. A gap 13 is the separation between two dashes 12 in the process direction 20. In various exemplary embodiments, the dash/gap (or on/off) period is designed for adequate raster optical scanner misalignment detection, as discussed in greater detail below. In the exemplary test pattern shown in FIG. 1, the length of the dashes is 4 pixels, and the gap between two dash lines is 4 pixels.

As shown in FIG. 1, a cross section 30 running across the test pattern 1000 in the cross process direction 22 goes through the dashed lines 10. The cross section 30 may intersect a dashed line 10 within a gap 13 between the dashes 12 of the dashed line 10. The cross section 30 may also intersect a dashed line 10 within a dash 12 of the dashed line 10. In addition, the cross section 30 may intersect a dashed line 10 at a tip or end of a dash of the dashed line 10. As will be discussed in greater detail below, a sensor response profile along the cross section 30 will have a maximal, minimal or intermediate value at a particular x-axis position depending on whether the cross section 30 intersects a dashed line 10 located at the particular x-axis position within a gap between the dashes, within a dash, or at a dash tip of the dashed line.

In various exemplary embodiments, the test pattern shown in FIG. 1 is produced by a printhead, with each dashed line produced by a corresponding nozzle of the printhead. In various other exemplary embodiments, the dashed lines are produced by nozzles of different printheads. In various other exemplary embodiments, the dashed lines represent an expected test pattern from precisely aligned printhead or printheads.

In various exemplary embodiments, the test pattern 1000 shown in FIG. 1 is used to detect roll. In various other exemplary embodiments, the test pattern 1000 shown in FIG. 1 is used to detect y-axis stitch.

Figure 2:
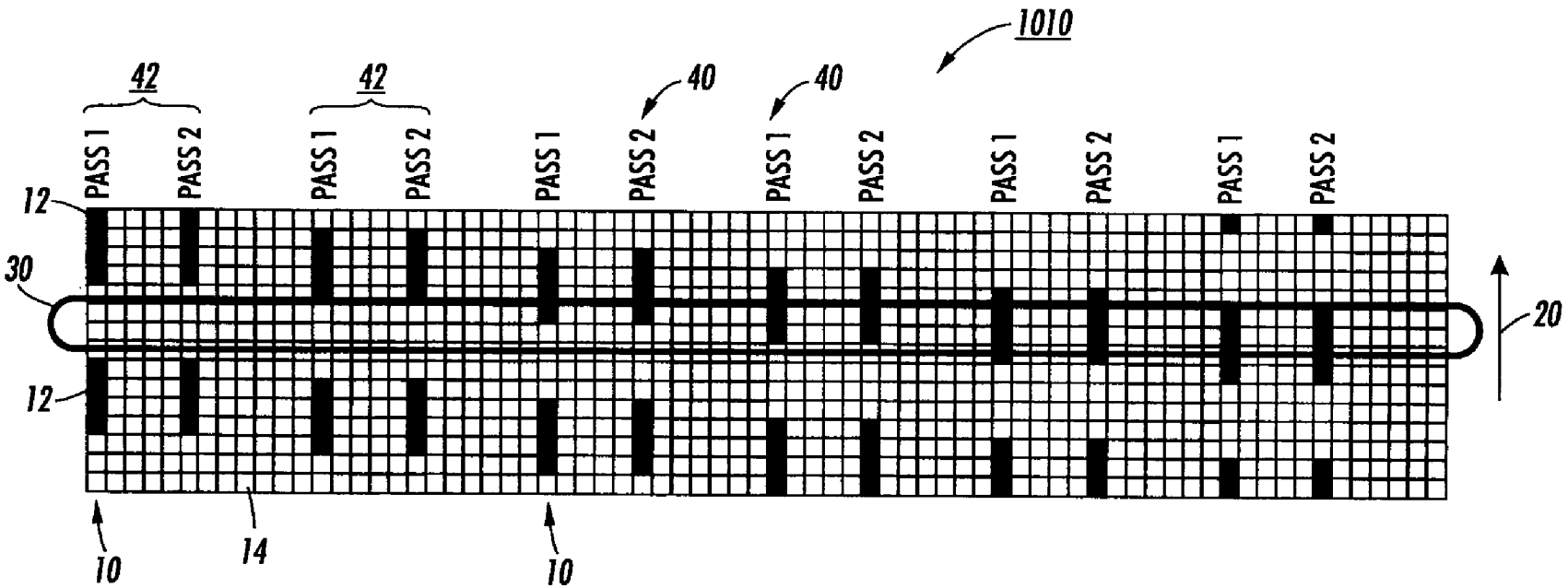
FIG. 2 illustrates a second exemplary embodiment of a test pattern according to this invention.

FIG. 2 illustrates another exemplary embodiment of a test pattern. In various exemplary embodiments, the test pattern 1010 shown in FIG. 2 is used to detect y-axis interlace.

The test pattern 1010 in FIG. 2 is similar to that shown in FIG. 1, except that the test pattern 1010 in FIG. 2 includes dashed lines 10 produced by different passes 40 of a printhead. In particular, as shown in FIG. 2, the dashed lines 10 produced by pass 1 and the dashed lines 10 produced by pass 2 are each substantially identical to the dashed lines 10 in FIG. 1. However, the dashed lines 10 from pass 1 and pass 2 are combined in the test pattern 1010 in FIG. 2, such that dash pairs 42 are formed. The dashes 12 in a dash pair 42 of a pair of dashed lines 10 are located in a same position in the process direction 20 without a shift. The dash pair 42 in a pair of dashed lines 10 shifts in the process direction 20 relative to a dash pair 42 of a neighboring pair of dashed lines 10. The shift may be any number of pixels 14. In the exemplary embodiment shown in FIG. 2, the shift is one pixel 14.

In various exemplary embodiments, the test pattern 1010 of FIG. 2 includes dashed lines 10 from two passes 40. In various other exemplary embodiments, the test pattern (not shown) includes dashed lines from more than two passes.

In various exemplary embodiments, a linear array sensor is used to detect process direction registration errors. In various exemplary embodiments, an inline linear array sensor is used. The linear array sensor detects the ink on the drum to enable the potential to measure printhead roll. In various exemplary embodiments, the full width array sensor is a contact image sensor with a row elements running completely across the process direction, an illumination source, and a set of graded index cylindrical lenses that focuses the drum image onto the sensors. In various other exemplary embodiments, the full width array sensor is linear array remote from the drum with an illumination source and reduction optics that focus the full width of the drum row onto the linear array sensor.

In various exemplary embodiments, a common integration time technique is used for gathering full width array sensor data. In such exemplary embodiments, the sensor responses are clocked out individually so that the reflectance of a set of points parallel to the axis of the rotation of the drum are read.

In various other exemplary embodiments, a sequential integration time technique is used for gathering full width array sensor data. In such exemplary embodiments, each sensor is clocked out in sequence, so the drum rotates some distance between the first read and the last read. This may have the effect of reading along a line rotated at some angle with respect to the cross process direction. With knowledge of the read time, the test pattern and the analysis thereof may be used for subsequent adjustment.

The presence of dashes changes sensor response. In particular, the presence of ink on the drum can either decrease or increase the response of sensors, depending on the relative colors of the ink and the drum and the texture of the ink and the drum. For the ease of discussion, it is assumed that the presence of ink decreases sensor response. However, it should be appreciated that the discussion below also applies when the presence of ink increases sensor response.

In various exemplary embodiments, as will be described in greater detail below in connection with FIGS. 1 and 2, a sensor response profile is obtained from a cross section along the cross process direction of a test pattern. As discussed above, the strength of the response at a particular cross process direction location in the response profile depends on whether the cross section intersects with a dashed line at the particular cross process direction location, and if the cross section intersects with a dashed line, whether the cross section intersects the dashed line between the dashes, within a dash, or at a dash tip of the dashed line. In particular, the strength or magnitude of the response in the response profile will reach a maximum at the particular cross process direction location if the cross section does not intersect a dashed line at the cross process direction location, because there is no dash to decrease the sensor response. Similarly, if the cross section intersects with a dashed line at the particular cross process direction location, but the cross section intersects with the dashed line between the dashes of the dashed line, the strength of the response at the cross process direction will still be close to the maximum response strength because there is no dash at the intersection to decrease the sensor response. However, if the cross section intersects the dashed line within a dash of the dashed line, the response strength will be a minimal, because the presence of the dash decreases the sensor response. When the cross section intersects the dashed line at a dash tip, the presence of the dash within the cross section is not complete. The decrease in sensor response will be reduced. Accordingly, the strength of the response will be at an intermediate magnitude between the maximum and the minimum.

In particular, as shown in FIGS. 1 and 2, a cross section 30 is used to indicate where a sensor detects dashes. In various exemplary embodiments, a cross section of sensor response is used to detect errors in a printed image. The cross section of the sensor response is a collection of profiles through the dashes in the test pattern. A profile includes sensor response along the cross process direction at a particular process direction location. In various exemplary embodiments, the cross section is a collection of profiles through all the dashes in a test pattern. In various other exemplary embodiments, the cross section is a collection of profiles through the dashes near the interface between two printheads.

In a response profile of a cross section of sensor response, sensor response varies along the cross process direction. As discussed above and shown in FIGS. 1 and 2, a sensor response profile along the cross section 30 will have a maximal, minimal or intermediate value at a particular x-axis position depending on whether the cross section 30 intersects a dashed line 10 located at the particular x-axis position within a gap between the dashes, within a dash, or at a dash tip of the dashed line. In particular, sensor response highs, or maxima, occur at locations corresponding to positions where dashes do not exist, such as the gaps between dashes. For example, as shown in FIG. 1, at the x-axis position where the dashed line containing dash A is located, the sensor response on the cross section 30 will be relatively high because the cross section 30 intersects this dashed line at a gap between the dashes of this dashed line. There is no dash at the intersection to decrease the sensor response, and the sensor response will be a high or maximum.

On the other hand, at the x-axis position where the dashed line containing dash G is located, the sensor response on the cross section 30 will be relatively low because the cross section 30 intersects this dashed line within a dash of this dashed line. The dash at the intersection decreases the sensor response, and the sensor response will be a low or minimum.

Furthermore, at the x-axis position where the dashed line containing dash B or E is located, the sensor response on the cross section 30 will be between the high and low values discussed above, because the cross section 30 intersects this dashed line at a dash tip.

The positions of the lows (minima) are used to obtain the locations of the corresponding dashes. In various exemplary embodiments, the positions of the lows (minima) are also used to obtain information of the nozzles which produced the dashes.

In various exemplary embodiments, the centers of the dashes may be determined based on the cross section of sensor response, using the minima in the response profile. The determination may be achieved by any existing or later developed techniques. In various exemplary embodiments, the center of a dash line is determined based on an interpretation of the response data near the dash line, a mid-point of the line edges of a detected dash line, a non-linear least squares fit, or a multi-dimension vector under Radar theory.

Figure 3:
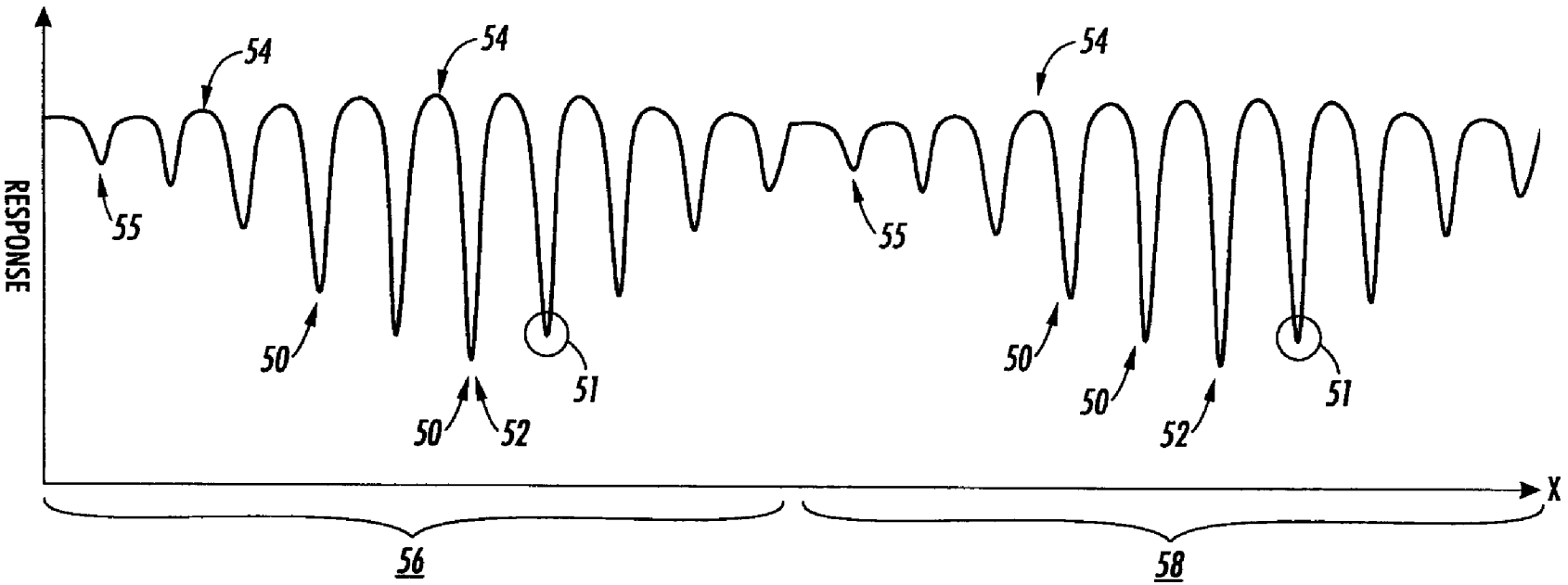
FIG. 3 illustrates a response profile according to an exemplary embodiment of this invention.

FIG. 3 illustrates a sensor response profile obtained from a cross section in the test pattern of FIG. 1. As shown in FIG. 3, the profile consist of a large response 54 for the response to the substrate and downward spikes of varying magnitudes for the response over the dashed lines. The length increases along the x-axis from that of the shortest spikes 55 to that of the longest spike 52, then decreases to that of the shortest spike 55.

The spikes 50 are located on the x-axis corresponding to the locations of the dashed lines 10 in FIG. 1. Each spike 50 indicates a reduction of response strength due to the presence of a respective dashed line that decreases the sensor response. Each spike has a spike tip 51 that identifies how low the sensor response has been reduced to.

As discussed above, the presence of a dashed line in the cross section decreases the sensor response differently, depending on whether the cross section intersects with the dashed line between dashes, within a dash, or at a dash tip of the dashed line. Such a variation in sensor response reduction is reflected in FIG. 3. As shown in FIG. 3, the longest spikes 52, indicating maximal sensor response reduction and minimal sensor response, appear at x-axis locations corresponding to the dashed lines with which the cross section intersects within dashes. The locations with gaps 54 between spikes 50, indicating minimal sensor response reduction and conformity to the constant response magnitude, appear at x-axis locations corresponding to dashed lines with which the cross section intersects within the gaps between dashes. The other, shorter spikes with intermediate length, indicating intermediate sensor response reduction and representing intermediate sensor response magnitude, appear at x-axis locations corresponding to dashed lines with which the cross section intersects at dash tips.

As shown in FIG. 3, the response profile periodically repeats the characteristics of a group of spikes. For example, the profile portion 56 is similar to the profile portion 58. This corresponds to the periodical configuration of dashed line groups 16 and 18, as shown in FIG. 1.

In various exemplary embodiments, registration errors are detected by first converting the sensor profile to a dash minimum response profile. The dash minimum response profile is a table of the sensor response at the minimum of each spike. The length of the sensor profile is equal to the number of sensor elements in the linear array. The length of the dash minimum response profile is equal to the number of nozzles writing the dashes in the test pattern.

Alternative metrics other than the sensor response at the minimum of each spike can be used to create the dash minimum response profile. One choice is the interpolated minimum of the spike, where the response of the linear array is interpolated between the sensors at each spike minimum. Another choice is the interpolated width of each spike taken at some point between the minimum response and the response of the substrate. Another choice is the integrated area under the spike.

Figure 4:
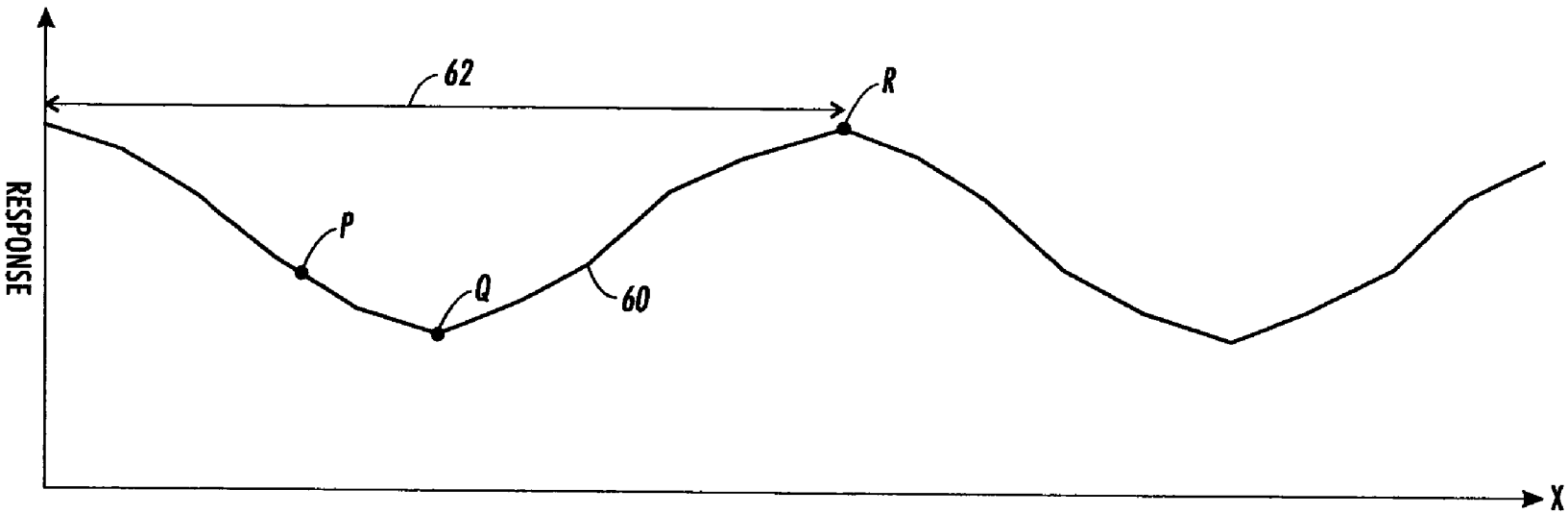
FIG. 4 illustrates an outline of the minimal responses of the response profile in FIG. 3.

FIG. 4 plots the dash minimum response curve. The period 62 of the dash minimum response curve 60 corresponds to the distance extended by a dashed line group 16, 18, as shown in FIG. 1, in the test pattern 1000.

For a particular point on the dash minimum response curve 60 in FIG. 4, such as point P, the location on the x-axis corresponds to the x-axis location of a respective dashed line 10 in FIG. 1. The phase of this point corresponds to the metric characterizing the respective spike 50 in FIG. 3, which indicates the amount of sensor response reduction caused by the respective dashed line 10 in FIG. 1. For example, point Q corresponds to the tip of a longest spike 52 in FIG. 3. Point R corresponds to the tip of the shortest spike 55 in FIG. 3.

In various exemplary embodiments, the frequency of the dash minimum response curve is used to detect roll. Roll is a rotation of the printhead about an axis normal to the drum. When the printhead has roll, the y-axis position of the nozzles of the printhead is a function of the x-axis position. Thus, for example, a one pixel offset (or shift) between dashes of adjacent dashed lines produced by adjacent nozzles will be different than one pixel. This difference will cause a change in the frequency of the dash minimum response profile produced from the response profile sensed from the dashed lines.

In various exemplary embodiments, each dashed line 10 in FIG. 1 is assigned a dashed line index based on the x-axis position of the dashed line. Accordingly, the x-axis in FIG. 3 may be replaced by dashed line indices, and the dash minimum response profile 60 in FIG. 3 may be expressed as a function of dashed line indices, as shown in FIG. 5.

Figure 5:
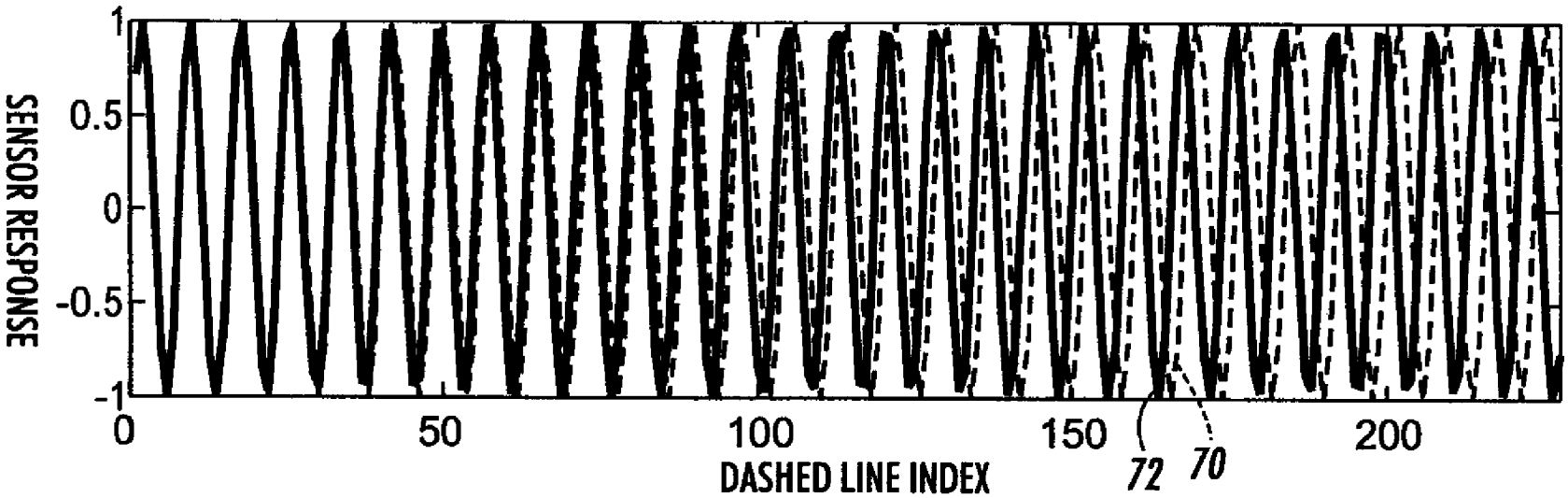
FIG. 5 illustrates a first sinusoidal curve and a second sinusoidal curve according to one exemplary embodiment of the present invention.

FIG. 5 shows two dash minimum response profiles 70 and 72. The profiles correspond to two different values for the head roll.

In various exemplary embodiments, the first sinusoidal curve is obtained from an aligned printhead, a simulated test pattern, or mathematical calculations.

As shown in FIG. 5, the first dash minimum response profile 70 has a longer wavelength, or lower frequency, than the second dash minimum response profile 72. The frequency difference between the first and second sinusoidal curves is proportional to the magnitude of the roll.

In various exemplary embodiments, the frequency change is determined using standard fast Fourier transform. When the changes are less than the frequency resolution of standard fast Fourier transform, various digital signal processing techniques are used to measure such small changes in frequency. In various exemplary embodiments, the small changes in frequency are determined using Chirp Z-Transform.

In various exemplary embodiments, the changes in frequency are determined by comparing the frequency of the second sinusoidal curve with an expected frequency. In such exemplary embodiments, the first sinusoidal curve need not be produced.

In various exemplary embodiments, the first and second sinusoidal curves in FIG. 5 represent dash minimum response profiles from two printheads. In such exemplary embodiments, the difference between the frequencies of the two sinusoidal curves indicates that one printhead has roll relative to the other printhead.

In various exemplary embodiments, the phase of the dash minimum response profile in FIG. 4 is used to detect y-axis stitch. Y-axis stitch shifts the image produced by one printhead with respect to the image produced by another printhead in the process direction. Because of the image shift between two printheads, a change occurs in the phase of the dash minimum response profile of the cross section between the two printheads, as shown in FIG. 6.

Figure 6:
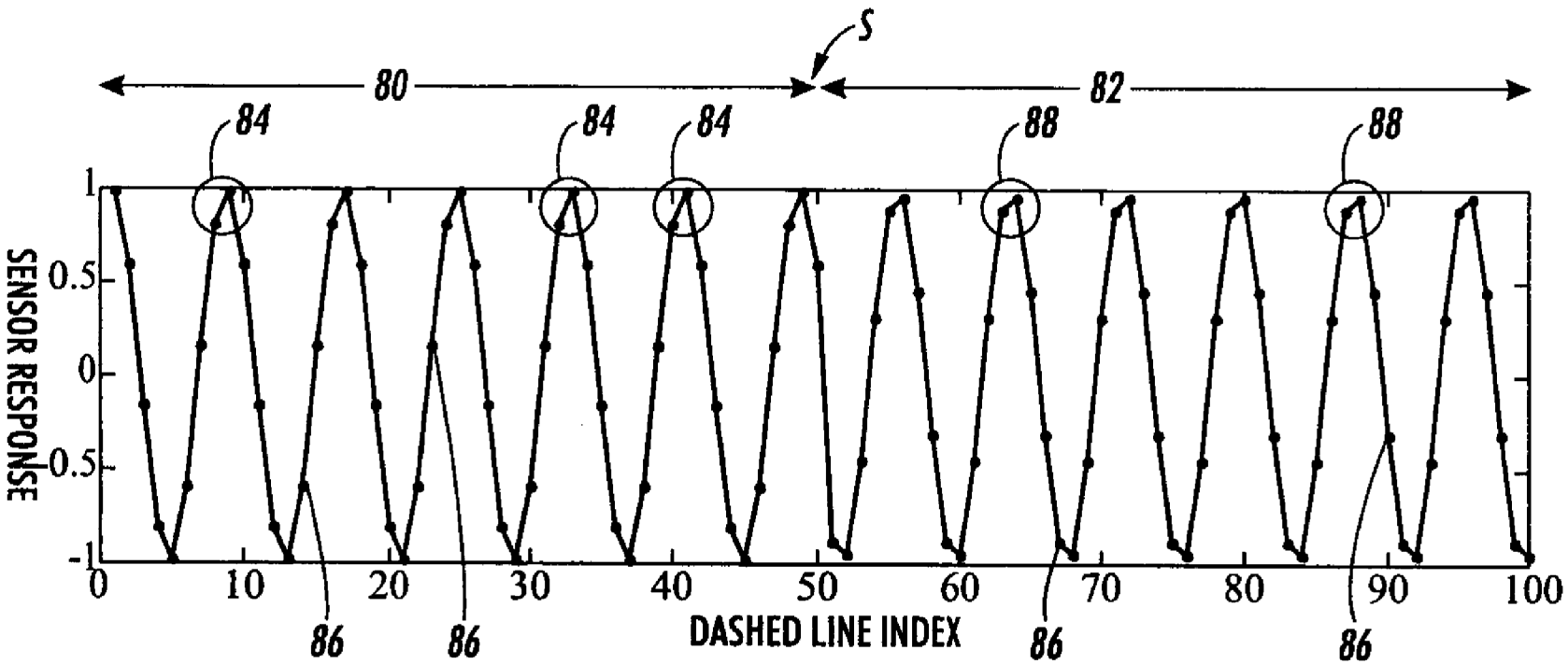
FIG. 6 illustrates first and second sinusoidal curves based on information from a first printhead and a second printhead, respectively, according to one exemplary embodiment of this invention.

FIG. 6 shows two outline curves 80 and 82. Curve 80 corresponds to the dashed lines produced by a first printhead, and curve 82 corresponds to the dashed lines produced by a second printhead. Dots 86 are superimposed on curves 80 and 82 at each measured dash position. The dots can be used to identify the phase shift. The phase change is evidenced by the change of the positioning of the dots 86 superimposed on curves 80 and 82. The period of the dash minimum response profile is 8 dashes which is determined by the test pattern. But the dots to the right of location S are shifted slightly relative to the corresponding dots to the left of location S. At the location S between curve 80 and curve 82, there is an abrupt change in phase.

The phase of the dash minimum response profile may be determined using a digital signal process technique. The difference in the phases of two curves may be used to determine y-axis offset between two printheads. In various exemplary embodiments, the relative y-axis offset between two printheads is determined by:

$$\Delta y=(n_{on}+n_{off})s\phi/(2\pi),$$

where $n_{on}+n_{off}$ is the repeat of the test pattern in pixels, s is the spacing between pixels, and $\phi$ is the phase difference. In various exemplary embodiments, s=42.3 μm for 600 spi printing.

In various exemplary embodiments, there is a dynamic range requirement for the detection of process direction stitch. The distance between the top of one dash to the top of the next dash in the process direction must be greater than the range in process direction stitch that is necessary to detect. A change in process direction stitch greater than the distance between dashes in the process direction is equivalent to a change in phase greater than $2\pi$ between the dash minimum response profiles from each printhead. A phase shift outside the range between $-\pi$ and $\pi$ cannot be distinguished than a phase in between the range $-\pi$ and $\pi$. If the required dynamic range is known, then the dash length can be chosen so the process direction stitch can be measured across the full dynamic range.

Figure 7:
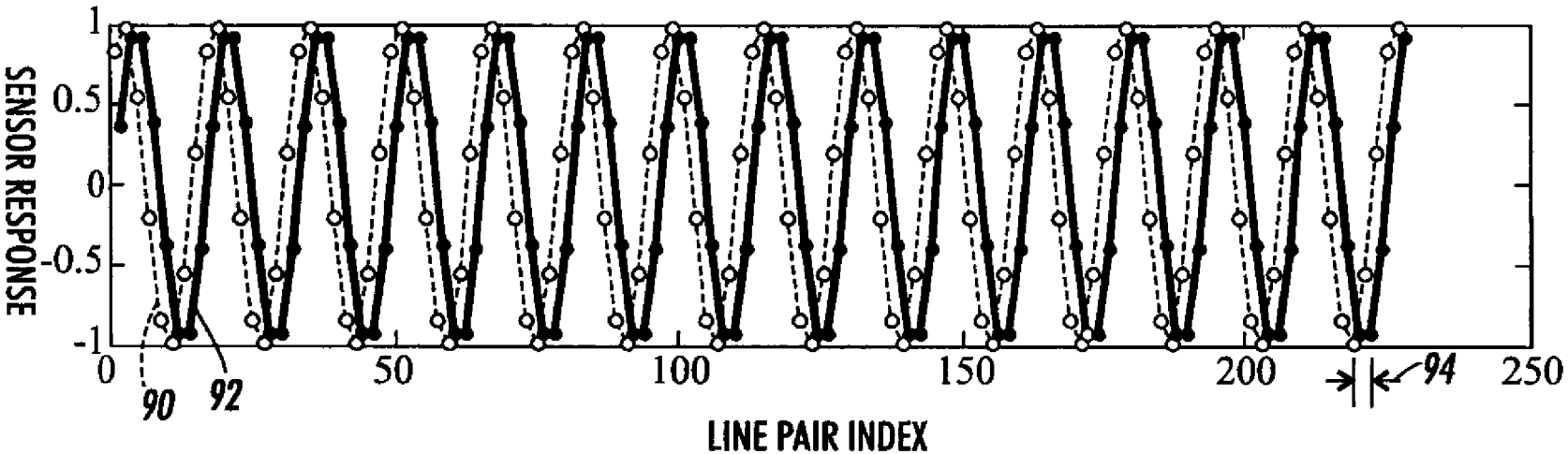
FIG. 7 illustrates first and second sinusoidal curves based on a first pass and a second pass, respectively, of a printhead according to one exemplary embodiment of this invention.

In various exemplary embodiments, the phase of the dash minimum response profile of FIG. 4 is used to detect y-axis interlace between two passes of a single printhead. FIG. 7 illustrates a first sinusoidal curve 90 (the black curve) and a second sinusoidal curve 92 (the gray curve) with a phase difference 94. The first dash minimum response profile 90 is determined from finding the metric associated with the spikes of the sensor response arising only from the dashes printed during the first pass. The second dash minimum response profile 92 is determined from a finding the metric associated with the spikes of the sensor response arising only from dashes printed during the second pass.

In FIG. 7, the dash minimum response profiles 90 and 92 are plotted against the nozzle index. In various exemplary embodiments, the nozzle index is a sequential identification numbering of the nozzles that produce the dashed line printed during the pass plotted. In various other exemplary embodiments, the dash minimum response curves are plotted against the x-axis location of the dashed line produced in the first pass, the dashed line produced in the second pass or a combination of the x-axis positions of the dashed line produced during the first pass and the dashed line produced during the second pass.

When there is no y-axis interlace, and the dash minimum response is plotted against the nozzle index, the two dash minimum response profiles in FIG. 7 should overlap. However, when there is a y-axis interlace, there is a difference between the phases of the two dash minimum response profiles 90 and 92. Accordingly, the two sinusoidal curves 90 and 92 do not overlap. In various exemplary embodiments, the difference between the phases of the two sinusoidal curves 90 and 92 is used to determine y-axis interlace.

The description above in connection with FIG. 7 uses only two passes. It should be appreciated that the description is not limited to two passes. Instead, the description can be generalized to any number of passes.

In various other exemplary embodiments, the y-axis interlace is determined by producing dashed lines during the first pass using only a subset (for example, the left hand side half) of the nozzles of the printheads, and producing dashed lines during the second pass using another subset (for example, the right hand side half) of the nozzles of the printhead. In such exemplary embodiments, sinusoidal curves will be produced that are similar to the sinusoidal curves 80 and 82 in FIG. 6, except that first curve 80 on the left hand side is produced during the first pass, and the second curve 82 on the right hand side is produced during the second pass. Accordingly, the phase shift or phase change between the first and second curves 80 and 82 indicates y-axis interlace.

The detected roll, y-axis stitch and y-axis interlace may be used for correction and adjustment. In various exemplary embodiments, these registration errors are measured at manufacturing during the alignment of the printheads. In various other exemplary embodiments, these registration errors are measured dynamically during printer operation. The measurements and adjustments may be repeated during the life of the printer. The adjustment may be made manually or automatically. In various exemplary embodiments, the adjustment is made automatically by mechanically adjusting the position of a printhead. In various other exemplary embodiments, the adjustment is made by adjusting the jet firing time to compensate for registration errors.

Figure 8:
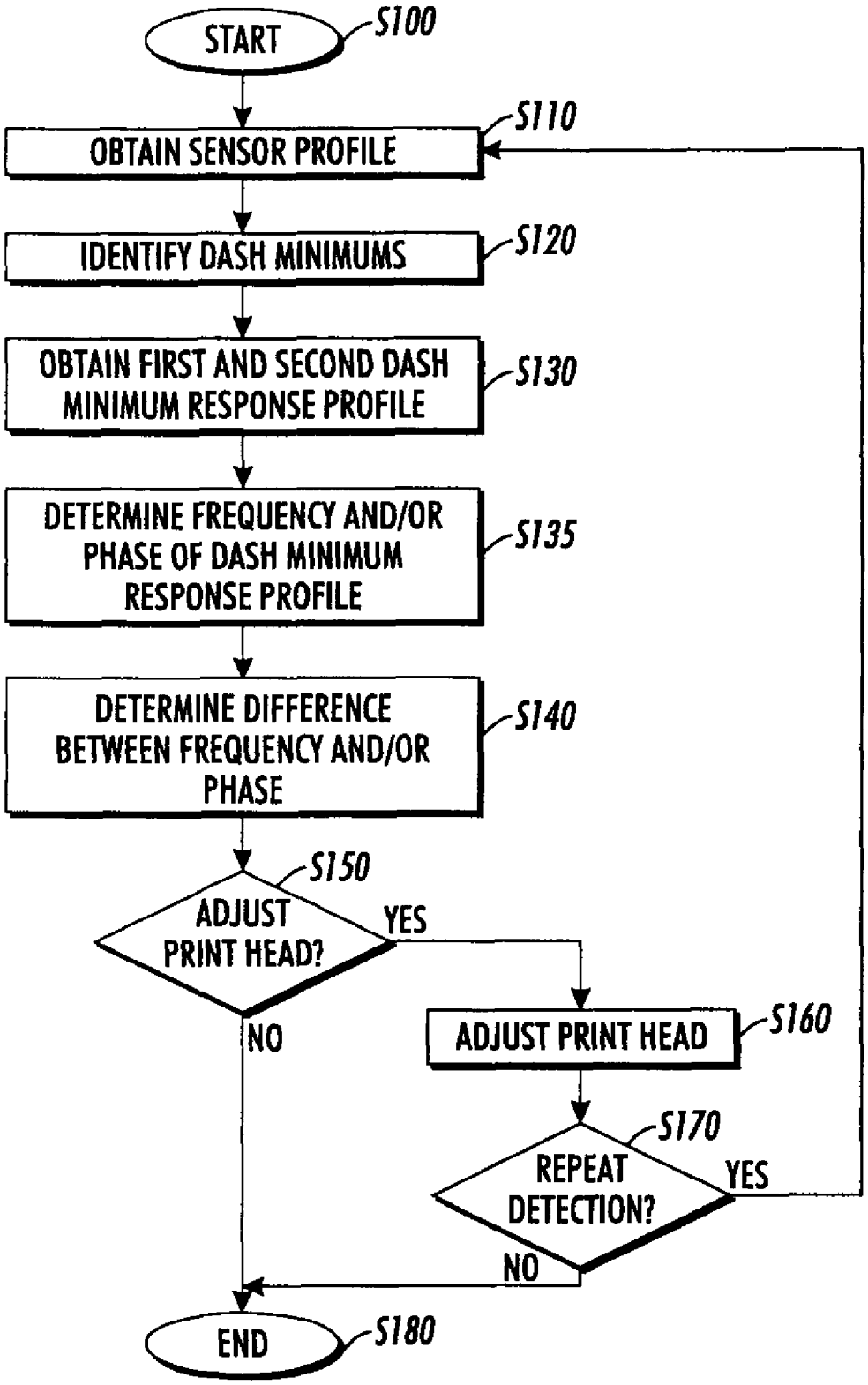
FIG. 8 is a flowchart outlining one exemplary embodiment of a method for detecting process direction registration errors according to this invention.

FIG. 8 is a flowchart outlining an exemplary embodiment of a method for detecting process direction registration errors according to this invention. As shown in FIG. 8, starting from step S100, operation of the method proceeds to step S110 to obtain a sensor response profile. Next, in step S120, the position of the dashes are identified from the sensor response profile. Next, in step S130, a first and second dash minimum response profile is obtained from the sensor response profile. A portion of the sensor profile is analyzed to obtain the first dash minimum response profile, and another portion of the sensor profile is analyzed to obtain the second dash minimum response profile. Process then continues to step S135.

In step S135, minima first and second metric is determined from the first and second dash minimum response profile. In various exemplary embodiments, the first metric is a frequency of the first dash minimum response profile. In various other exemplary embodiments, the first metric is a phase of the first dash minimum response profile.

Next, in step S170, a difference between the first and the second metrics is determined. Then, operation of the method proceeds to step S180.

In step S180, a determination is made whether to adjust a printhead or printheads. If it is determined in step S180 to adjust a printhead or printheads, operation continues to step S185. If not, operation proceeds to step S195.

In step S185, the printhead or printheads is adjusted to reduce, correct, eliminate or minimize errors. Then, operation continues to step S190.

In step S190, a determination is made whether to detect errors again. If it is determined in step S190 to detect errors again, operation jumps back to step S110, where the detection process gets repeated. If not, operation proceeds to step S195, where operation of the method ends.

It should be noted that steps S130-S135 may be replaced by a step in which a reference metric is obtained. The reference metric may be obtained from calculations without the obtaining the second outline or second sinusoidal curve. The reference metric may also be predetermined.

Figure 9:
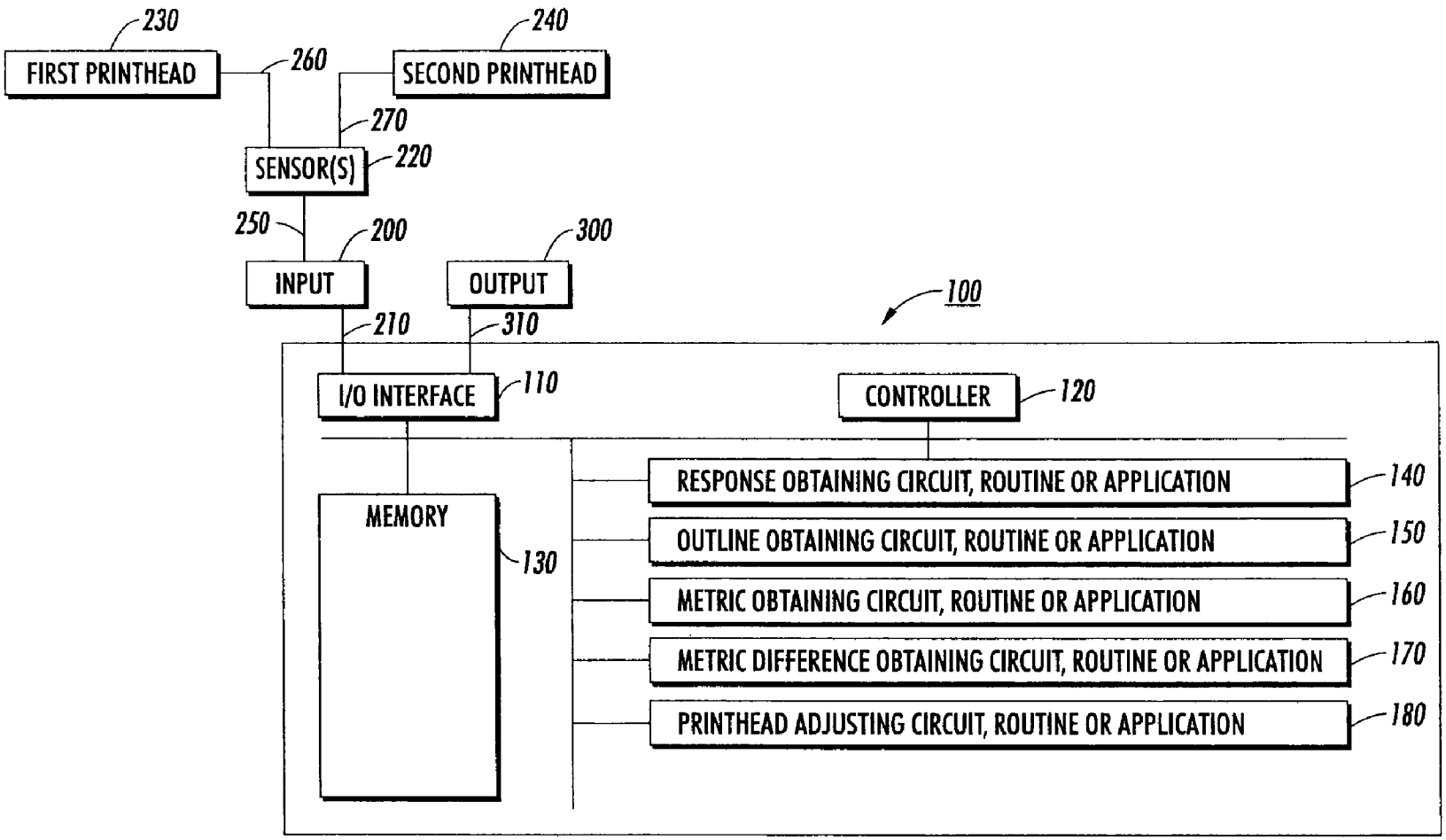
FIG. 9 is a functional block diagram of an exemplary embodiment of a system for detecting process direction registration errors according to this invention.

FIG. 9 is a functional block diagram of an exemplary embodiment of a system for detecting process direction registration errors according to this invention. As shown in FIG. 9, the system 100 may include an input/output (I/O) interface 110, a controller 120, a memory 130, a response obtaining circuit, routine or application 140, an outline obtaining circuit, routine or application 150, a metric obtaining circuit, routine or application 160, a metric difference obtaining circuit, routine or application 170, and a printhead adjusting circuit, routine or application 180, each interconnected by one or more control and/or data buses and/or application programming interfaces 190.

In various exemplary embodiments, the system 100 is implemented on a programmable general purpose computer. However, the system 100 can also be implemented on a special purpose computer, a programmed microprocessor or microcontroller and peripheral integrated circuit elements, an ASIC or other integrated circuits, a digital signal processor (DSP), a hard wired electronic or logic circuit, such as a discrete element circuit, a programmable logic device such as a PLD, PLA, FPGA or PAL, or the like. In general, any device capable of implementing a finite state machine that is in turn capable of implementing the flowchart shown in FIG. 8 can be used to implement the system 100.

The input/output interface 110 interacts with the outside of the system 100. In various exemplary embodiments, the input/output interface 110 may receive input from the input 200, such as sensor responses, via one or more links 210. The input/output interface 110 may output data to the output 300 via one or more links 310.

The memory 130 may store any data and/or program necessary for implementing the functions of the system 100. The memory 130 can be implemented using any appropriate combination of alterable, volatile, or non-volatile memory or non-alterable or fixed memory. The alterable memory, whether volatile or non-volatile, can be implemented using any one or more of static or dynamic RAM, a floppy disk and a disk drive, a writable or rewritable optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or a DVD-ROM disk and disk drive or the like.

In the exemplary embodiments of the system 100 shown in FIG. 9, the response obtaining circuit, routine or application 140, under control of the controller 120, receives sensor response from the sensors 220 which read in the printed test pattern from the first printhead 230 and/or the second printhead 240 via the respective one or more links 260 and 270 and then sends the sensor response using link 250 to input 200 via the one or more links 210 and the input/output interface 110. The outline obtaining circuit, routine or application 150, under control of the controller 120, obtains a sinusoidal curve based on the sensor response. The metric obtaining circuit, routine or application 160, under control of the controller 120, obtains a metric from the sinusoidal curve. In various exemplary embodiments, the response obtaining circuit, routine or application 140, the outline obtaining circuit, routine or application 150, and the metric obtaining circuit, routine or application 160 may obtain data from and/or send data to the memory 130.

The metric difference obtaining circuit, routine or application 170, under control of the controller 120, obtains a difference between two metrics. In various exemplary embodiments, the two metrics are both obtained by the metric obtaining circuit, routine or application 160. In various other exemplary embodiments, the two metrics include one metric obtained by the metric obtaining circuit, routine or application 160, and another metric prestored in the memory 130.

In various other exemplary embodiments, the metric difference and/or its related data is used for the printhead adjusting circuit, routine or application 180 to adjust a printhead or printheads to reduce or correct errors. Further, in such exemplary embodiments, the controller 120 may control the various circuits, routines or applications to detect errors again after adjusting the printhead or printheads.

The method illustrated in FIG. 8 may be implemented in a computer program product that can be executed on a computer. The computer program product may be a computer-readable recording medium on which a control program is recorded, or it may be a transmittable carrier wave in which the control program is embodied as a data signal.

In various exemplary embodiments, systems, such as the system shown FIG. 9, may be included in a marking device, such as an inkjet printer, or the like.

While particular embodiments have been described, alternatives, modification, variations and improvements may be implemented within the spirit and scope of the invention.

What is claimed is:

1. A method for detecting a process direction registration error in a marking device, comprising:

printing a test pattern of dashes, each dash extending in a process direction;

obtaining a sensor profile from sensor responses to the test pattern, the sensor profile containing a plurality of minimum responses;

converting the sensor profile to a minimum response profile based on the minimum responses in the sensor profile, the minimum response profile having approximately a shape of a sinusoidal curve;

determining a first value, the first value being a phase of a first section of the minimum response profile, the first section of the minimum response profile obtained from a part of the sensor profile corresponding to dashes printed with a first pass of a printhead of the marking device;

determining a second value, the second value being a phase of a second section of the minimum response profile, the second section of the minimum response profile obtained from a part of the sensor profile corresponding to dashes printed with a second pass of the printhead of the marking device;

determining a phase difference between the first and second values; and determining a process direction interlace between the first and second passes based on the phase difference between the first and second values.

2. The method of claim 1, the second value being predetermined.

3. The method of claim 1, wherein a plurality of dash pairs are formed by each dash printed in the first pass corresponding to a respective dash printed in the second pass, the dashes within each dash pair of the plurality of dash pairs are located at the same position in the process direction, and the dashes of different dash pairs of the plurality of dash pairs are staggered in the process direction.

4. A method for detecting a process direction registration error in a marking device, comprising:

printing a test pattern of dashes, each dash extending in a process direction;

obtaining a sensor profile from sensor responses to the test pattern, the sensor profile containing a plurality of minimum responses;

converting the sensor profile to a minimum response profile based on the minimum responses in the sensor profile, the minimum response profile having approximately a shape of a sinusoidal curve;

determining a first value, the first value being a frequency of a first section of the minimum response profile, the first section of the minimum response profile obtained from a part of the sensor profile corresponding to dashes printed with a first printhead of the marking device;

determining a second value, the second value being a frequency of a second section of the minimum response profile, the second section of the minimum response profile obtained from a part of the sensor profile corresponding to dashes printed with a second printhead of the marking device;

determining a frequency difference between the first and second values; and determining a roll in the process direction of the first and second printheads based on the frequency difference between the first and second values.

5. The method of claim 4, the second value being predetermined.

6. The method of claim 5, the test pattern including dashes oriented and extending substantially a same length in the process direction, neighboring dashes being staggered in process direction, and the neighboring dashes in a cross process direction being spaced from each other at substantially equal distance in the cross process direction.

7. A system for detecting a process direction registration error in a marking device, comprising:

a printhead that prints a test pattern of dashes, each dash extending in a process direction;

a plurality of sensors that obtain responses to the dashes;

a response obtaining circuit, routine or application that obtains a sensor profile from the responses of the plurality of sensors, the sensor profile containing a plurality of minimum responses;

an outline obtaining circuit, routine or application that converts the sensor profile to a minimum response profile based on the minimum responses in the sensor profile, the minimum response profile having approximately a shape of a sinusoidal curve;

a metric obtaining circuit, routine or application that obtains a first value and a second value, the first value being a phase of a first section of the minimum response profile, the second value being a phase of a second section of the minimum response profile, the first section of the minimum response profile obtained from a part of the sensor profile corresponding to dashes printed with a first pass of the printhead, the second section of the minimum response profile obtained from a part of the sensor profile corresponding to dashes printed with a second pass of the printhead; and a metric difference obtaining circuit, routine or application that determines a phase difference between the first and second values, the metric difference obtaining circuit, routine or application determining a process direction interlace between the first and second passes based on the phase difference between the first and second values.

8. The system of claim 7, the second value being predetermined.

9. The system of claim 7, wherein a plurality of dash pairs are formed by each dash printed in the first pass corresponding to a respective dash printed in the second pass, the dashes within each dash pair of the plurality of dash pairs are located at the same position in the process direction, and the dashes of different dash pairs of the plurality of dash pairs are staggered in the process direction.

10. A marking device including the system of claim 7.

* * * * *